US006237760B1

(12) United States Patent
Parker et al.

(10) Patent No.: US 6,237,760 B1
(45) Date of Patent: May 29, 2001

(54) PACKAGING OF SMOKING ARTICLES

(75) Inventors: Michael Patrick Parker, Leighton Buzzard; David John Bates, Winslow, both of (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 09/284,986

(22) PCT Filed: Nov. 19, 1997

(86) PCT No.: PCT/GB97/03184

§ 371 Date: May 12, 1999

§ 102(e) Date: May 12, 1999

(87) PCT Pub. No.: WO98/22368

PCT Pub. Date: May 28, 1998

(30) Foreign Application Priority Data

| | | |
|---|---|---|
| Nov. 21, 1996 | (GB) | 9624274 |
| Aug. 6, 1997 | (GB) | 9716699 |
| Oct. 3, 1997 | (GB) | 9721080 |

(51) Int. Cl.[7] ..... B65D 85/10

(52) U.S. Cl. ..... 206/273

(58) Field of Search ..... 206/259, 266, 206/268, 271, 273

(56) References Cited

U.S. PATENT DOCUMENTS

| | | | | |
|---|---|---|---|---|
| 1,755,579 | * | 4/1930 | Grupe | 206/268 |
| 1,877,955 | | 9/1932 | Ottinger . | |
| 2,719,663 | | 10/1955 | Meyer-Jagenberg . | |
| 2,896,839 | | 7/1959 | Barnes et al. . | |
| 3,027,998 | * | 4/1962 | Ridgeway | 206/271 |
| 3,999,655 | * | 12/1976 | Molins et al. | 206/259 |
| 4,119,196 | * | 10/1978 | Flaherty | 206/271 |
| 4,300,676 | | 11/1981 | Focke et al. . | |
| 4,420,080 | | 12/1983 | Nakamura . | |
| 4,606,956 | | 8/1986 | Charbonneau et al. . | |
| 4,632,299 | | 12/1986 | Holmberg . | |
| 4,679,693 | | 7/1987 | Forman . | |
| 4,720,423 | | 1/1988 | Fraser . | |
| 4,763,779 | | 8/1988 | Focke et al. . | |
| 4,771,882 | | 9/1988 | Lowe et al. . | |
| 4,771,891 | | 9/1988 | Sorensen et al. . | |
| 4,784,261 | * | 11/1988 | Kutchin | 206/271 |
| 4,850,482 | | 7/1989 | Campbell . | |
| 5,029,712 | | 7/1991 | O'Brien et al. . | |
| 5,096,113 | | 3/1992 | Focke . | |
| 5,125,211 | | 6/1992 | O'Brien et al. . | |
| 5,158,664 | | 10/1992 | Colgan et al. . | |
| 5,249,676 | | 10/1993 | Ashcraft et al. . | |
| 5,333,729 | | 8/1994 | Wolfe . | |
| 5,333,735 | | 8/1994 | Focke et al. . | |
| 5,427,235 | * | 6/1995 | Powell et al. | 206/271 |
| 5,511,658 | | 4/1996 | Focke et al. . | |
| 5,556,026 | | 9/1996 | Blankitny . | |

FOREIGN PATENT DOCUMENTS

| | | |
|---|---|---|
| 0119314 A2 | 12/1979 | (EP) . |
| 378 586 B1 | 7/1989 | (EP) . |
| 0447636 B1 | 12/1990 | (EP) . |
| 0546369 A1 | 6/1993 | (EP) . |
| 633202 A2 | 1/1995 | (EP) . |
| 789627 | 1/1958 | (GB) . |
| 918388 | 8/1959 | (GB) . |
| 1514174 | 6/1978 | (GB) . |
| 2140774 | 12/1984 | (GB) . |
| 2264483 | 9/1993 | (GB) . |
| WO 87/02645 | 5/1987 | (WO) . |

* cited by examiner

*Primary Examiner*—Jim Foster
(74) *Attorney, Agent, or Firm*—Jones, Tullar & Cooper, PC

(57) ABSTRACT

A pack for cigarettes and like smoking articles has a frame (101) outside the charge of cigarettes but inside a flexible wrap, which is preferably a sealed enclosure of a barrier material such as a metal/plastic laminate, or metallized foil. The inner frame which is not rigid since its side (104) and end (108) flaps are free except where attached to a major panel (102) acts to collate and protect the charge of cigarettes and to allow heat-sealing or other sealing pressure to be exerted more efficiently than would otherwise be possible.

29 Claims, 13 Drawing Sheets

PACKAGING OF SMOKING ARTICLES

BACKGROUND OF THE INVENTION

This invention relates to the packaging of smoking articles such as cigars, cigarillos and cigarettes. They will be referred to herein for brevity and clarity as cigarettes.

Cigarette packs fall into two broad classes rigid and soft. Soft packs are more common in the USA and Japan. They are as the name implies formed essentially of soft sheet materials. Rigid packs, more frequently encountered in Europe, have an outer shell of card to contain a charge of cigarettes.

The rigid type allows for good protection of the cigarettes and of any inner wrappings such as a barrier layer provided to hinder moisture ingress or escape, but they are quite complex in construction and assembly and can be a significant cost factor.

Soft packs are simpler and cheaper but there is more risk of damage to the contents in transport or handling.

The present invention proposes a new form of packaging for cigarettes which may be described as semi-rigid.

In the prior art, various reinforcement or protective sheets have been placed between a charge of cigarettes and an outer wrap.

GB-A-2264483, for example, shows a folded cap of card placed over the vulnerable ends of a charge of cigarettes.

GB-A-1514174 has an inner liner with front and back panels linked through a base panel, and side panels, forming an open-ended box within an outer wrapper. EP-A-633202 shows an external open-topped box into which a wrapped charge is inserted.

GB-A-918388 has a largely rigid box within a wrapper but one side panel of the box is not secured as in a conventional pack and can be depressed inwardly so as to allow severance of the outer wrapper for access to the cigarettes.

U.S. Pat. No. 1,755,579 has a frame around a charge of cigarettes that is overwrapped with tin foil or equivalent.

SUMMARY OF THE INVENTION

In the packaging of the invention a pack of cigarettes has a frame of card or equivalent material with a major panel, two side flaps and at least a partial end flap placed adjacent a face, sides, and at least part of at least one end, respectively, of the charge of smoking articles, and a flexible barrier sheet wrapping the charge end frame and sealed around them, as in GB-A-1514174 as far as a single end flap is concerned. In the invention, however, all of the sealed seams overlie at least partly a part of the frame.

The frame is preferably open and may be channel-like (that is, the side flaps are not linked except through a sole major panel), but will have at least partial end flaps. There is usually no rigid shell outside the flexible sheet, though the pack may have an outer wrap, outside the sealed barrier sheet of, for example, a transparent plastic or cellophane, to give protection to the pack-forming sheet and, if desired, barrier properties.

The barrier sheet is a barrier material such as a metal foil/plastics laminate or a metallised plastics film. It is sealed to form an enclosure around the charge and frame which is as far as practical hermetic. Formation of sealed seams in a wrapping of barrier layer, especially on the sides of a pack, is assisted by the presence of the side panels of the inner frame which abut against the cigarettes of the charge and spread the pressure exerted by the sealer on them. This is especially useful when the charge has different numbers of cigarettes in different rows, as in a 7-6-7 array, when otherwise a channel would tend to be formed in the sides.

The pack will be provided with means for giving access to the charge of cigarettes; there may be a tear strip around at least part of the pack circumference near the end intended to be its top end so that part of the sheet may be wholly or more preferably only partly separated. In the latter case the inner frame may include, integrally or separately, an internal lid-defining portion to facilitate reclosure of the pack.

Separation for the purpose of access may be provided for, or assisted by, line(s) of weakening or partial cuts in the pack-forming sheet.

A sealed enclosure may be resealable. In that case, an access aperture is defined in the barrier layer and a cover is provided which may extend over the aperture and engage the barrier layer adjacent all sides of the aperture. The cover has a permanently tacky surface for engaging the barrier layer, allowing the packaging to be resealed after accessing the cigarettes through the aperture.

The wrapper or barrier layer may be continuous over one minor end of the pack or charge, and have side seams along both minor sides of the pack and an envelope or similar fold over the opposite minor end. The layer need not be applied in that manner—it can equally well be applied so as to be continuous over one minor side and sealed over both minor ends and one minor side.

Various patterns of heat sealable portions of barrier layer, achieved by the application of glue, lacquer or the like to the barrier material, can when heat-sealed with each other or with the barrier material form an enclosure which is as near as possible hermetic.

Furthermore, flavourant may be provided in the permanently tacky adhesive used for resealing such a barrier layer. Thus, a quantity of the flavourant will be released each time the cigarettes are accessed. This contrasts with previously known systems (such as described in U.S. Pat. No. 5,249,676) which release only a single burst of flavourant, on initial opening of the packaging.

The flavourant is preferably micro-encapsulated, each action of disengaging the tacky surface from the barrier layer causing a proportion of the micro-capsules to be ruptured, and so release their contents. U.S. Pat. No. 4,720,423, again relating to a one-off flavourant release system, describes how flavourant-bearing micro-capsules may be incorporated into adhesive.

By flavourant is meant any substance which releases, produces, neutralises, masks or alters odours, for example a perfume or deodorant.

Flavourant may alternatively or additionally be incorporated into an integer which is included inside the wrapping. The integer may be of a porous substance, for example a pad, a paper sheet or may be the card inner frame of a semi-rigid pack. Alternatively, the flavourant may be encapsulated or included in a sachet, the capsule or sachet being included within the packaging.

This flavourant may permeate the cigarettes included within the packaging, so as to affect the taste or odour of smoke produced when smoking the cigarettes. A preferred such flavourant is menthol.

Flavourant may be incorporated into both a resealable adhesive layer (outside a barrier layer) and an insert (inside the wrapping). The flavourants may be the same, so that their effects reinforce, or different, for example to provide one flavour on opening the packaging and a different flavour in the cigarette.

We also disclose an inner frame, particularly suitable for the resealable packaging of this invention. Such an inner frame has panels which are foldable relative to each other to form four at least partial faces of a cuboid including one major face, and additionally has a flap or flaps which form(s) an incomplete fifth face of the cuboid.

In a preferred configuration, the frame has a major panel, two elongate side wings and a (bottom) end panel, and two flaps. The long edges of the side wings and the end panel are the major edges and a minor edge, respectively, of the major face. The flaps are at the top ends of the side wings. Thus, upon folding, the frame forms a major face, two long side faces and a bottom end face of a cuboid, with the flaps forming two parts of an incomplete top end face.

It is preferable that the major face is not a complete rectangle, but has a recess in the top edge. When such a recess is present, it is further preferable that the end panel is shaped so that two blank, unfolded, frames placed end-to-end tessellate (i.e. can lie next to each other without overlaps or gaps) thus minimizing the amount of material needed.

When this inner frame is used in a resealable pack, the aperture in the barrier sheet through which cigarettes may be accessed preferably overlies the region between the flap(s) and the recess in the major panel. The flap(s), being supported on any cigarettes remaining in the pack (because it is preferable that the length of the side edge is similar to that of the cigarettes), provide(s) an anvil which supports the barrier layer adjacent the aperture, allowing the adhesive cover to be pressed firmly against the barrier layer, to aid resealing.

Of course, inner frames may have single folds between the panels (producing sharp edges) or double folds (producing bevelled edges). Alternatively, the sides of the frame may be rounded, for example to be used in a so-called "oval" pack.

Furthermore, multiple charges, each within an inner frame, may be overwrapped together in a single pack-forming sheet, to form a semi-rigid pack containing multiple charges.

Flavourant may be added to the packaging in the form of so-called "scratch and sniff" panels. That is, the flavourant may be coated on the packaging in a form (for example micro-encapsulated) which allows release of the flavourant when abraded. Such scratch and sniff panels are well known, for example in magazine advertisements for perfume.

Seams of the wrapper may be formed using glue or heat-sealable strips which are added to the wrapper, for example by being printed on. This finds particular applicability when the wrapper is a metal/paper laminate or metallized paper. However, one or more external faces of a plastic laminate or foil may be of heat-sealable material.

DETAILED DESCRIPTION OF THE PREFERRED EMBODIMENTS

Figure 1:
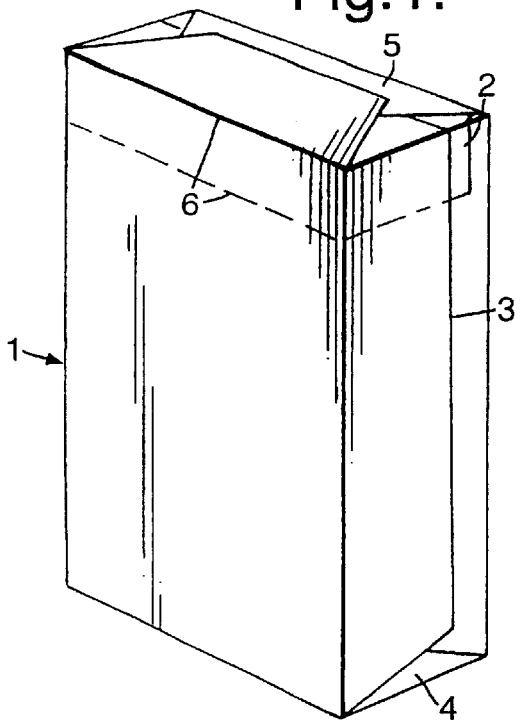
FIG. 1 is a perspective view of a first embodiment of pack in its closed condition.

In FIG. 1 a sheet of flexible barrier material such as a metal foil-laminated plastics or a metallized flexible plastics sheet has been overwrapped round an inner frame and a charge of cigarettes to form a pack of cigarettes. It is heat sealed or otherwise permanently sealed to itself to form a closed pack. It may be overwrapped by an outer soft layer such as cellophane or a transparent plastics (not shown).

Near the top of the pack a reinforcing tear strip is secured inside the barrier material from one side seam 3 to the other (not shown) with a tab 2 left exposed beyond seam 3 for handling by the user when he wishes to gain access to the cigarettes, having removed any outer overwrap. Alternatively the tab 2 may have been protected by an adhesive patch, such as a coupon, label or excise stamp.

Separation of the barrier material due to operation of the tear strip may, if necessary, be assisted by lines of weakening 6 in the barrier material which should not however harm its barrier properties. For example a laser cut line may penetrate only part of the thickness of the plastic of a metallized plastic sheet leaving the metallization undisturbed.

The folding of the sheet (the nature of which is described with reference to FIG. 6) around the charge, and its folding 4 near the base of the pack and on its top surface 5 are operations readily carried out on, for example, Molins HLP or Schemermund cigarette packaging machinery modified for the provision of an effectively full-length inner frame, to allow for the presence of the tear strip and to perform the requisite heat or other sealing.

Figure 2:
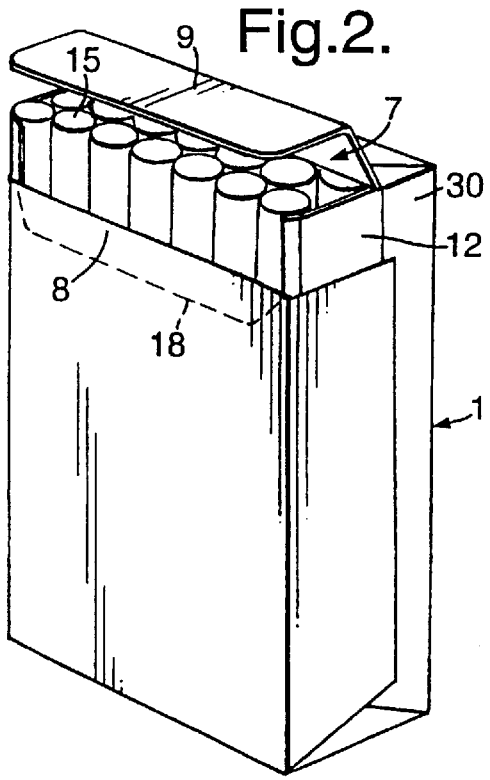
FIG. 2 shows the pack open.

FIG. 2 shows the pack after the tear strip has been used to remove a strip of the barrier material. A lid portion of the frame remains attached in the pack by bonding to the inside of the top surface 5 of the pack and can be folded upwardly by the user. The pack can be reclosed by tucking the lid of a flap 9 into the lip 8 of the barrier material formed by the removal of the tear strip 2.

Figure 3:
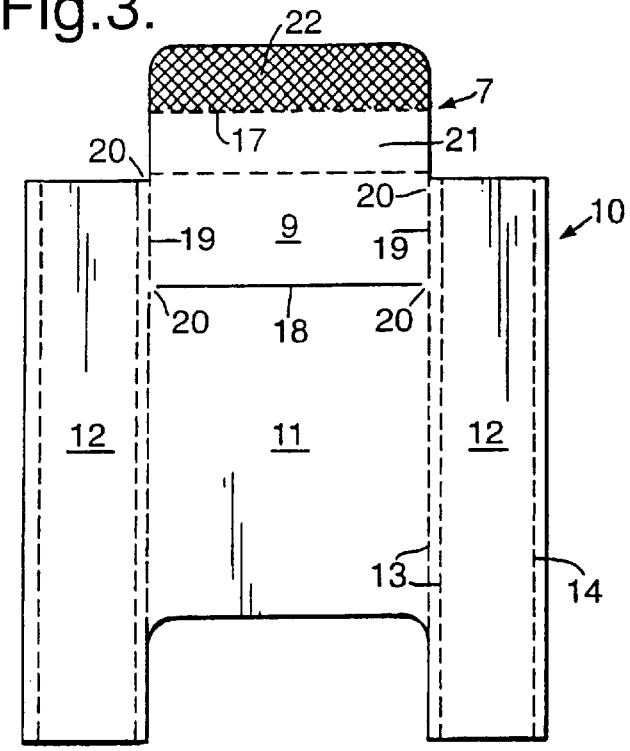
FIG. 3 is a face view of a blank for an inner frame of the embodiment.
Figure 4:
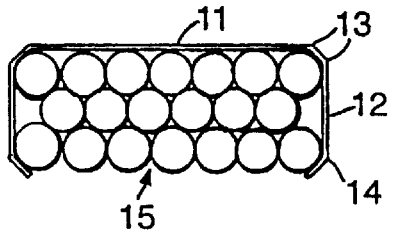
FIG. 4 is a top view of the frame folded to accommodate a charge of cigarettes.

Looking now in more detail at the structural elements of the pack, FIG. 3 shows the blank for the inner frame. The blank 10 has a central portion 11 which is to form a front panel and side wings 12 which are hingedly linked to the front panel and are to be folded at right angles to it. Between the panels however is a double score line or line of weakening 13 and at the edge of each wing a score line 14 which results in a conformation best seen in FIG. 4 with angled corners when the wings 12 are brought round to right angles to the panel 11 and the inner frame forms a channel in which a charge 15 of cigarettes, here twenty of them, is contained.

At the top of panel 11 a cut line 18 defines an end of the flap 9 of a lid-forming portion 7 of the blank 10. At the sides of the flap mutually inner lines 13 are continued as cut lines 19, but interruptions 20 in and between the cut lines ensure that the lid portion 7 remains attached to the remainder of the blank until deliberately severed from it. Hinge panel 21 joins the flap 9 to an end panel 22 of the lid-forming portion 7, defined by hinge line 17.

Figure 5:
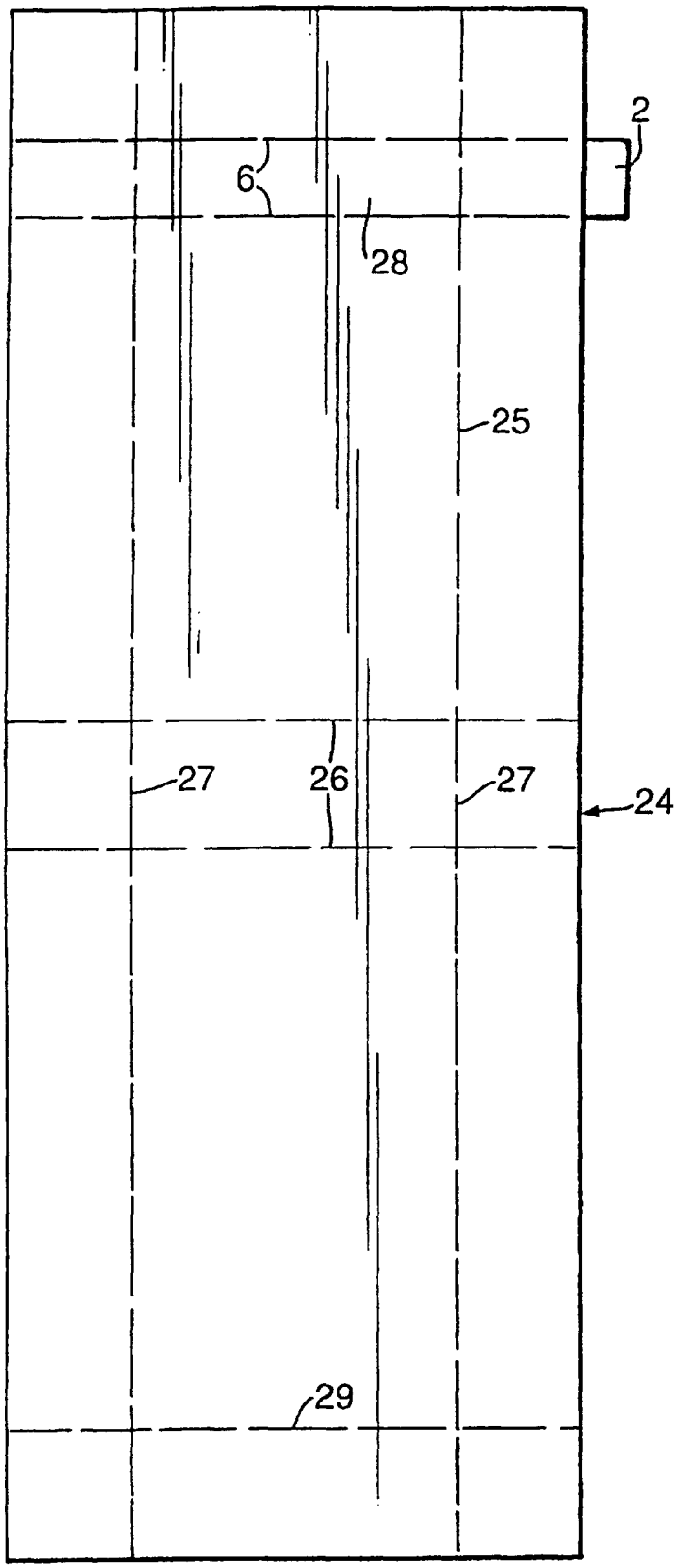
FIG. 5 is a face view of a sheet for overwrapping the frame and cigarettes.

A sheet 24 of material which is to form the wrap around the inner frame and its charge of cigarettes is seen in FIG. 5. The sheet 24 is rectangular and when brought around the inner frame and its charge of cigarettes it will first fold at lines 26 at the front and back respectively of the base of the inner frame with its charge. Then, folds are formed at the side of the base by folding at positions 27 of the lines 25. Then it is folded along lines 25 to overlie the side wings 12 of the inner frame and form side seams 3. Diamond folds are formed at its top 5 using the flaps beyond the tear strip 28 and beyond fold line 29, and all overlapping parts are sealed together to form a hermetic enclosure.

Lines 6 show the edges of tear strip 28 which underlies the sheet and offers the tab 2 already described. These edges may be followed by lines of weakening or partial cuts in the material of the sheet 24.

End panel 22 is heat-sealed, or otherwise permanently sealed, to the inner surface of the barrier material forming the top 5. Hinge-line 17 corresponds with the edge of the overlying portion of the sheet 24.

To open the pack the user removes any outer wrap or adhesive patch and pulls the tab 2 to remove the barrier material between lines 6 and side seams 3 at the front of, and front portions of the sides of, the pack 1. The end panel 22 remains attached to the inside surface of the sheet 24 and, via remaining portions 30 of the sides of the barrier layer of the pack, remains attached to the rest of the pack. The flap 9, whose lower edge at cut line 18 lies below the lip 8 of material left after the tear strip has been removed, can be folded upwardly and backwardly on the hinge panel 21, breaking the discontinuities 20, to gain access to the cigarettes. To reclose the flap 9 may be tucked into the lip again.

Figure 6:
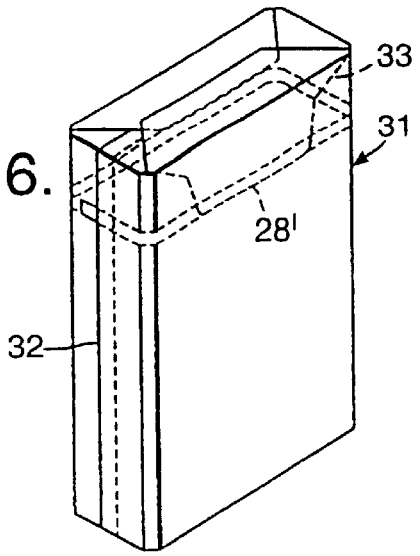
FIGS. 6 and 7 are perspective views of a second embodiment in closed and open conditions respectively.
Figure 7:
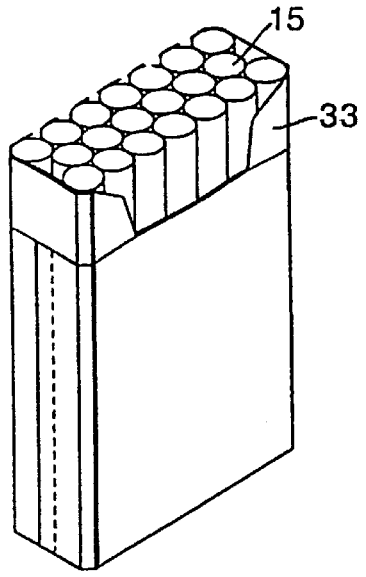

The embodiment in FIGS. 6 and 7 is a package 31 having a single side seam 32 in the barrier material wrapped around an inner frame 33. This mode of folding is performed, for example, on a GD machine. A tear strip 28' goes all the way round the package so that when tab 2' is pulled, the whole of the upper part of the barrier material is removed, exposing the cigarettes 15 as seen in FIG. 7, no lid portion being provided on the inner frame blank.

Figure 8:
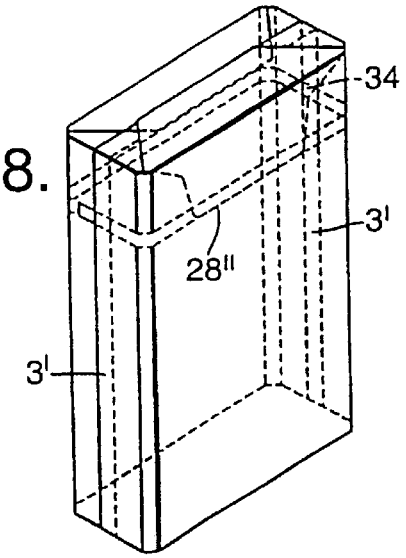
FIGS. 8 and 9 are perspective views of a third embodiment in closed and open conditions respectively.
Figure 9:
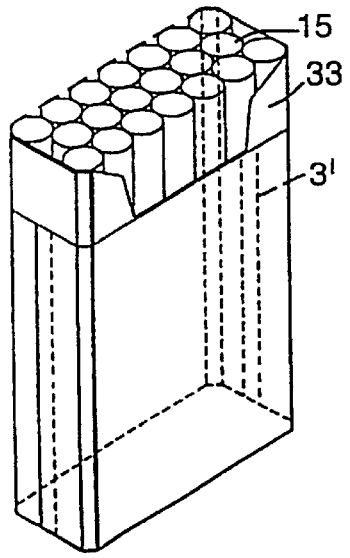

FIGS. 8 and 9 show how a tear strip 28" may extend all around a pack having two side seams 3', as in the first embodiment. Tear strip 28" has two components, welded to each other in the region 34 upon the folding up and heat sealing of the barrier material. Upon severance by this tear strip the cigarettes 15 are presented in the inner frame 33 as seen in FIG. 9.

Figure 10:
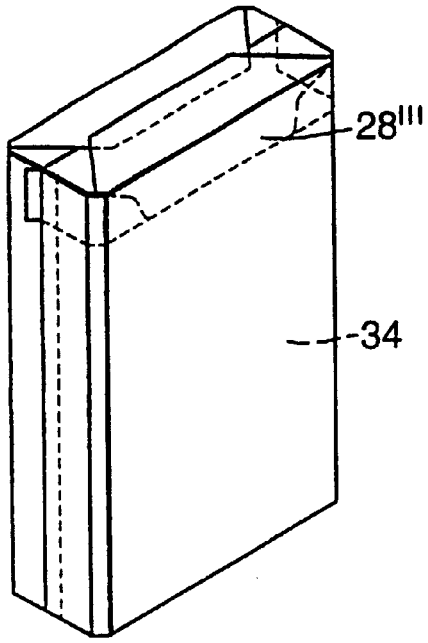
FIGS. 10 and 11 are perspective views of a fourth embodiment in closed and open conditions respectively.

FIG. 10 shows how a tear strip 28'" may extend from one side to the other of a pack, the inner frame 34 of which does not have a lid portion.

Figure 11:
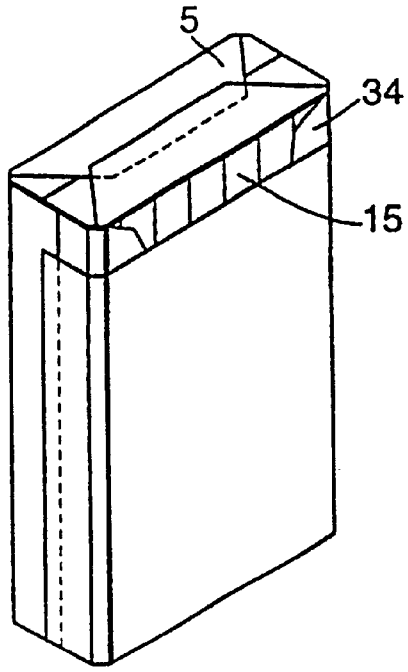

When the tear strip 28'" is pulled to sever a strip of the barrier material of the pack, the result is as shown in FIG. 11. The envelope folded top 5 of the pack remains attached by its rear edge and part of its side edges and can be folded along its major mid-line to give access to the cigarettes 15 but retain some lid-like function. In such embodiments one edge of the tear strip should coincide with the edge of the top 5, otherwise folding of the top will involve distortion or tearing of the barrier material.

Figure 12:
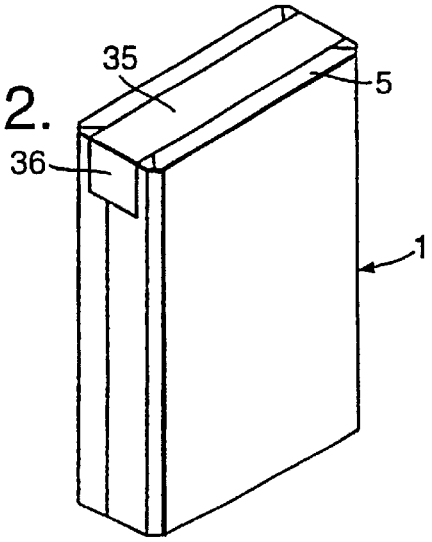
FIG. 12 shows an adhesive label in position.

FIG. 12 shows how an adhesive patch such as a coupon, label or excise stamp 35 can be used to protect the top 5 of the pack of, for example, the first or fourth embodiment. A portion 36 of the patch goes down over the side of the pack which has the tab 2 and covers over that tab both to prevent accidental opening and to provide a tamper-proof indicator.

Figure 13:
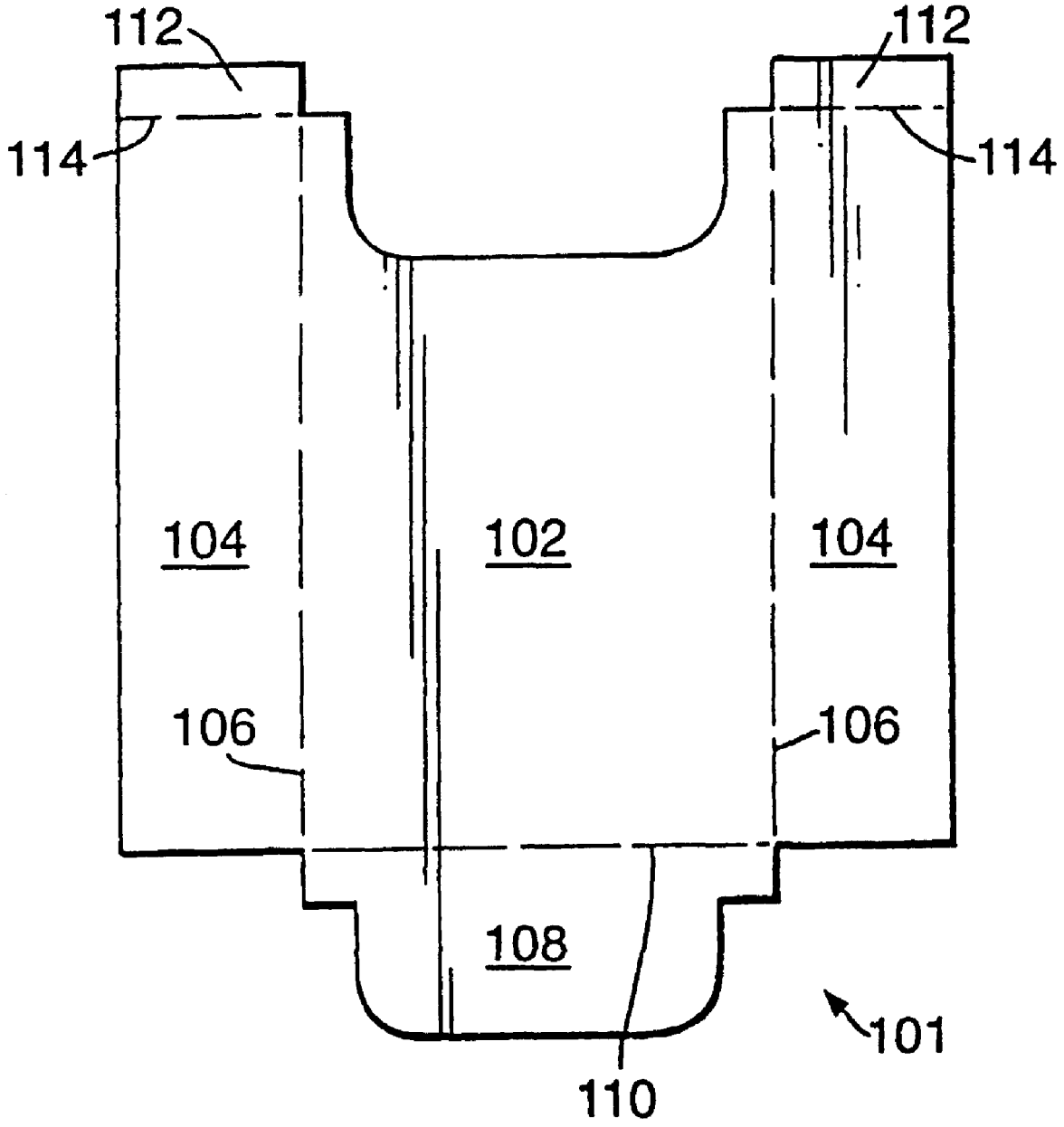
FIG. 13 shows a fifth embodiment of inner frame according to the present invention, in an unfolded state.
Figure 14:
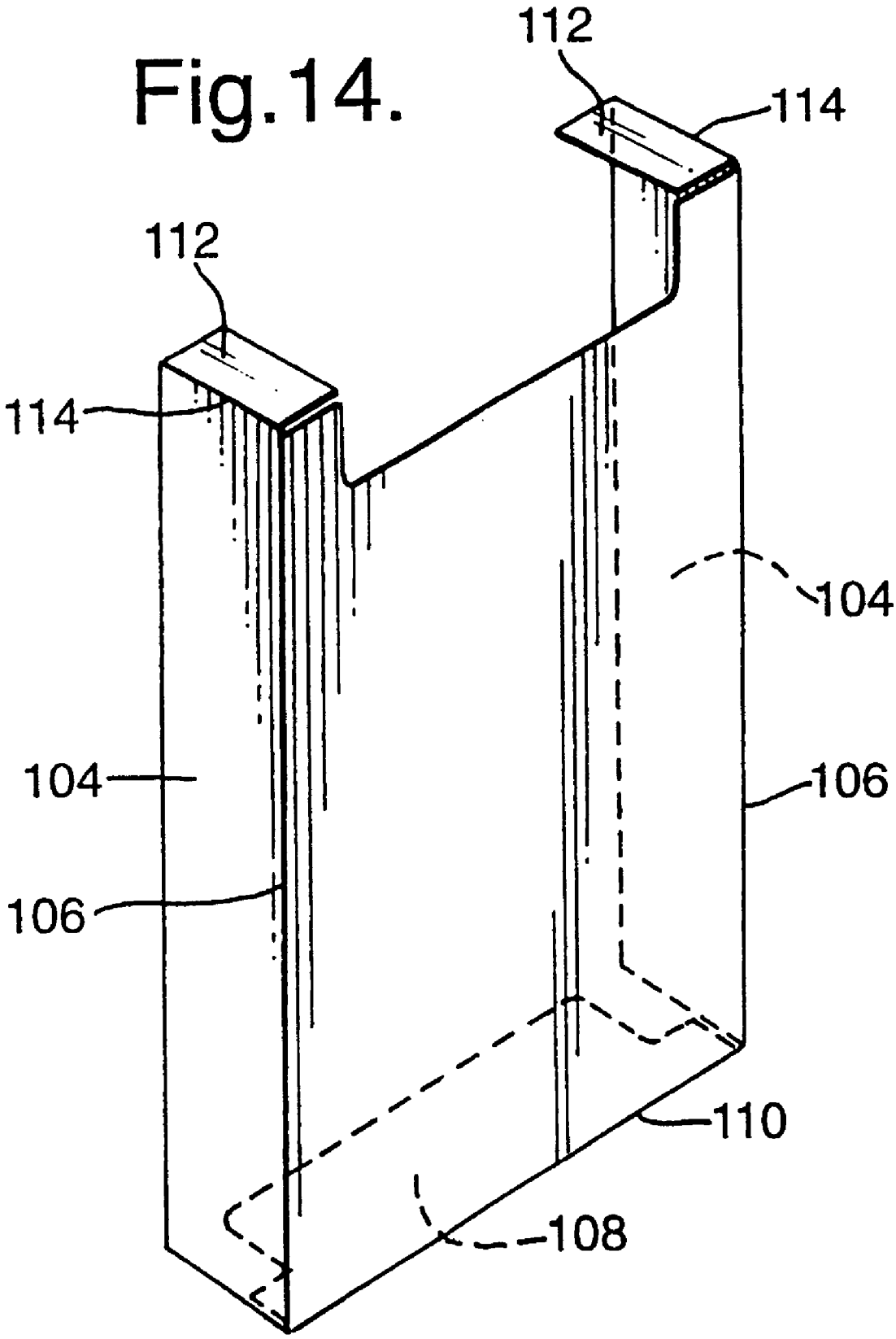
FIG. 14 shows the inner frame of FIG. 13 in a folded state.

FIGS. 13 and 14 show an inner frame usable with any form of barrier layer but has the advantage for a resealable enclosure of end flaps on the top face.

An inner frame 101 as shown in FIG. 13 is formed from a blank sheet of stiff card or similar foldable material. A major panel 102, which is generally rectangular, has elongate rectangular side wings 104 extending from the two major edges 106, the long edges of the side wings being co-extensive with the major edges 106. A generally rectangular end panel 108 extends from a minor edge 110 (the "bottom" edge) of the major panel, the long edge of the end panel being co-extensive with the bottom edge. At the top ends of the side wings are small rectangular flaps 112, which are effectively continuations of the side wings, along the top edges 114 of the side wings.

FIG. 14 shows the inner frame folded inwardly along lines 106, 110, 114, the panels and wings 102, 104, 108 forming four faces of a cuboid, the flaps 112 forming two ends of an incomplete fifth face.

The major panel 102 is not a complete rectangle, having a recess in its top edge. The bottom panel is shaped to match the recess, so that, as can be seen from FIG. 13, two unfolded frames laid end-to-end would tessellate.

In the resealable semi-rigid pack the major face forms the front of the pack, with the aperture for cigarette access overlying the recess in the major face and the gap in the top face between the two flaps. The two flaps 112, when supported by cigarettes remaining in the pack, provide an anvil against which the adhesive cover of the resealable barrier layer may be pressed to ensure good resealing. The length of the major edges of the major face of the major panel 102 is similar to that of the cigarettes to be contained, so that end cigarettes supported, and may be gently squeezed longitudinally by, those flaps by virtue of the latter being wrapped by the barrier layer.

A flavourant-bearing integer can be included inside the barrier layer, for example a sachet, capsule, scratch-pad or porous sheet. Alternatively the inner frame can be made of card on which is coated or in which is included a flavourant, e.g. menthol.

Microcapsules bearing flavourant can be included in the permanently tacky adhesive of a resealable enclosure so that flavourant is released each time the cigarettes are accessed. A suitable adhesive is available from Sessions of York, Huntington Road, York YO3 9HS, England.

Figure 15:
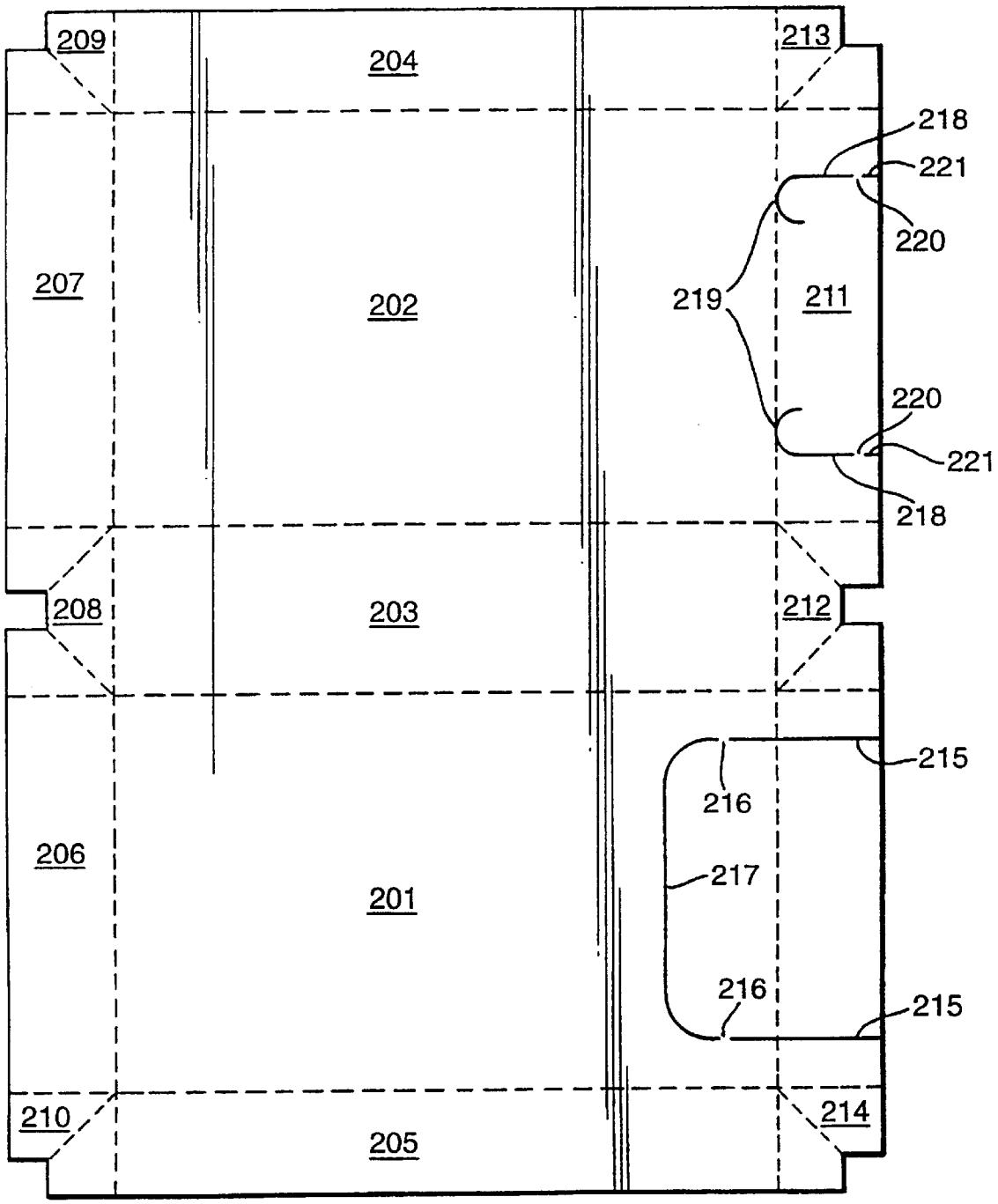
FIG. 15 shows a second embodiment of cut blank of barrier material.

FIG. 15 shows a cut blank for forming a barrier seal around a charge of smoking articles, usually contained in an inner frame. This blank is generally applicable in all the situations envisaged above and may be made of any of the materials mentioned there, but differs in that it is designed to be applied by folding around one minor side edge of the charge and of any inner frame rather than around one minor end.

The blank has major panels 201 and 202 which are respectively to be front and rear panels of the made-up package. An intermediate panel 203 will be continuous around one of the minor side edges of the charge. End panels 204 and 205 will overlie each other on the other of the side panels of the charge and will be heat sealed together in a seam.

To one edge of panels 201 to 205 are respective end flaps 206 and 207 on the major panels and gussets 208, 209 and 210 on the minor panels. First, end panels 206 and 207 are folded in and gussets 208,209 and 210 are then folded out. The end panels and gussets are then sealed, usually, as with the side seam between panels 204 and 205, by heat sealing, and then the gussets are tucked to lie along the side panels, where they may be tacked in position.

At the other edge of the panels 201 to 205 are other end flaps and gussets 210 to 214 respectively which correspond generally to flaps and gussets 206 to 210 but which, in flaps 210 and 211, are slit so as to form an openable access flap for the user of the eventual pack to gain access to its contents.

Flap 210 is interrupted by parallel cuts 215 which extend into the main front panel 201 to a narrow bridge 216. A U-shape cut 217 extends from one bridge to the other in the main panel 201.

In end flap 11 parallel cuts 218 extend to the potential fold line which divides panel 202 from flap 211 being there brought round in a J form at 219.

Adjacent to the extreme edge of the flap 211 are bridges 220 and beyond bridges 220 short final cuts 221 co-linear with cuts 218 and extending to the free edge of the flap 211.

Figure 16:
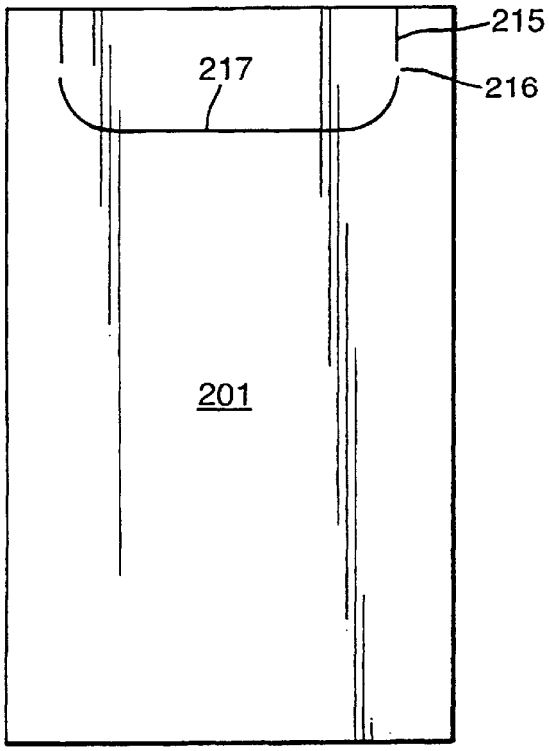
FIG. 16 shows a front view of the second embodiment when made up into a container.

FIG. 16 shows how the main panel 201 and the cuts 215 and 217 and bridges 216 may appear when the pack is made up. Of course, since the pack is resealable the cuts will not be visible since they will be overlaid by the resealable permanently adhesive layer. Furthermore, the pack may be contained within an outer carton of any suitable type and/or be overwrapped.

Figure 17:
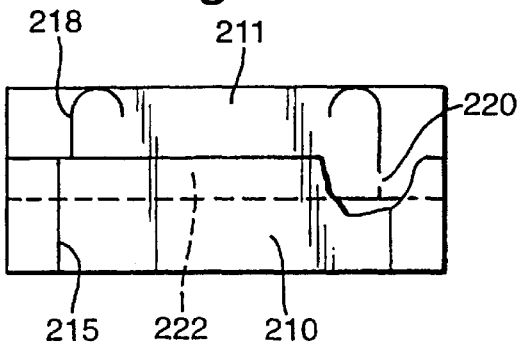
FIG. 17 shows a top plan view of the second embodiment when made up into a container, with a small portion cut away.

FIG. 17 shows a top view of the barrier enclosure when made up around a charge, flap 210 having been heat sealed in the region 222 over flap 211. It can be seen that the spacing apart of cuts 215 is slightly greater than that of cuts 218 so that they do not coincide in the made-up pack, there thus being continuity of barrier action. Flap 210 has been cut away somewhat to show the position of bridge 220 between cuts 218 and 221.

Figure 18:
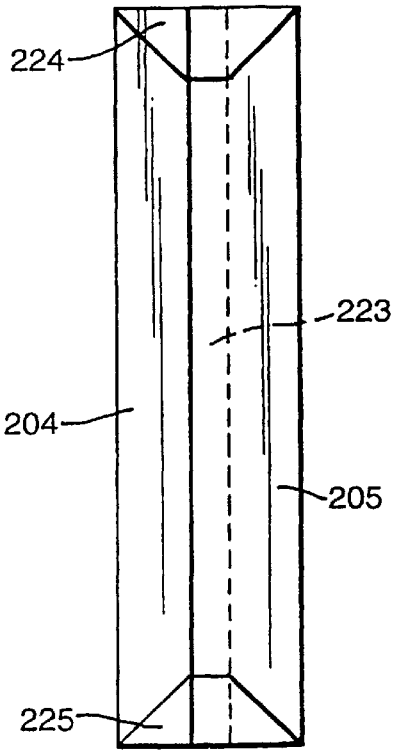
FIG. 18 shows one side view of the second embodiment when made up into a container.

FIG. 18 shows a side seam heat sealed region 223 between side flaps 204 and 205, with gussets 209,210,213, 214 forming grocer's folds 224,225 at the top and bottom ends of that minor edge of the pack.

Figure 19:
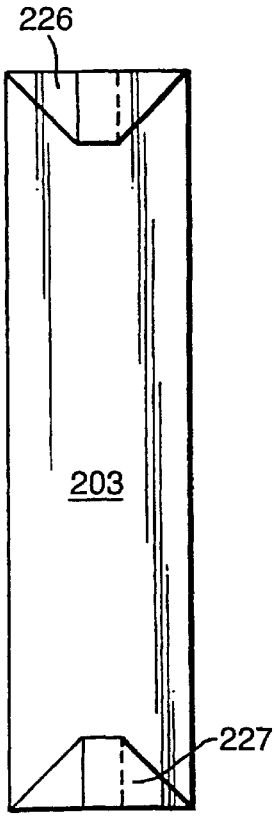
FIG. 19 shows the other side view of the second embodiment when made up into a container.
Figure 20:
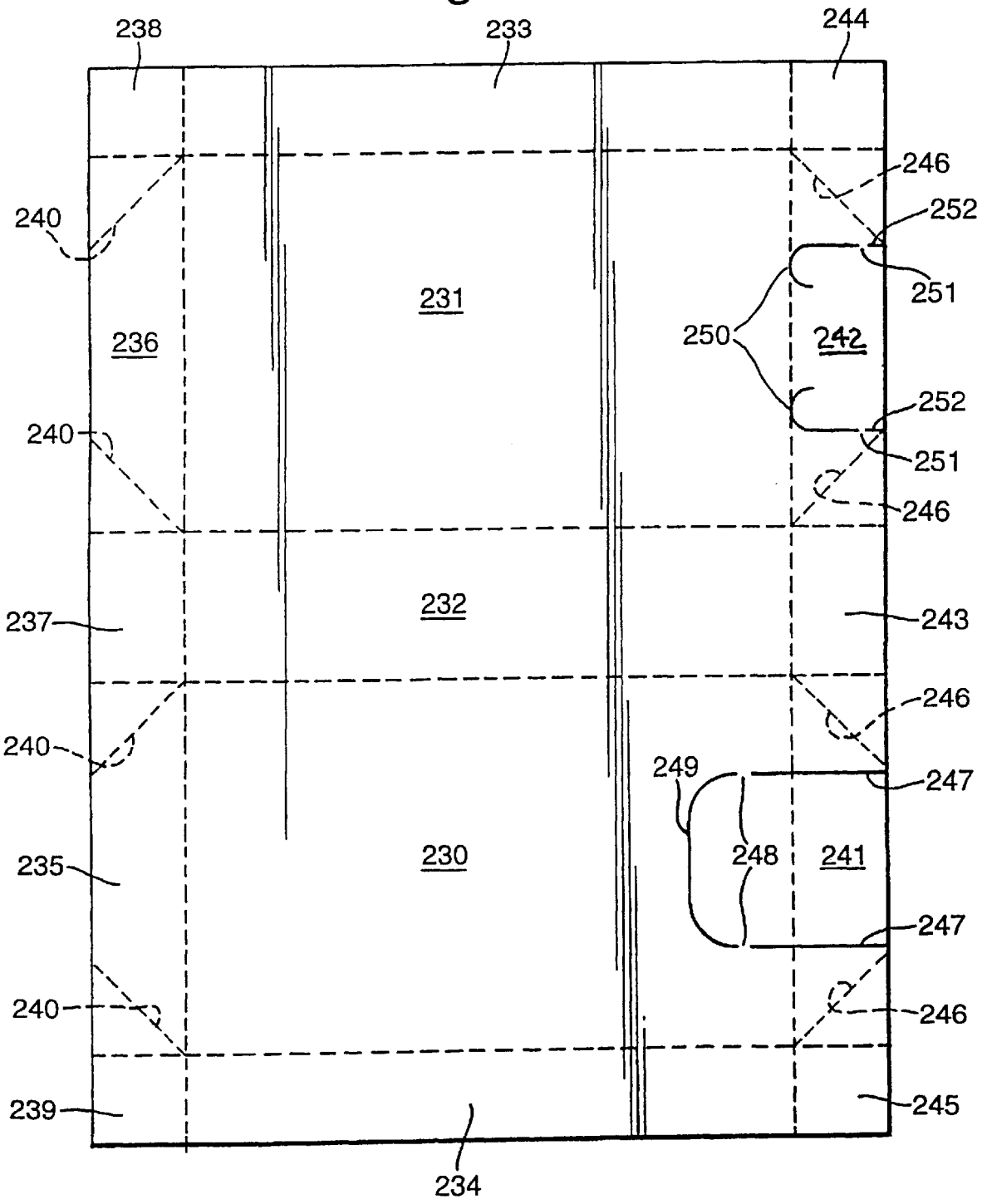
FIG. 20 shows a third embodiment of cut blank of barrier material.

The opposite minor edge as seen in FIG. 19 shows the continuity of the barrier material around it and folds 226,227 formed by gussets 208 and 212.

In the third embodiment of blank seen in FIGS. 20 to 26, different folding means are provided, giving a cleaner effect to the side walls of the made-up pack but somewhat restricting the width available for the formation of an access flap.

In this embodiment of blank main panels 230 (FIG. 20) and 231 are front and back panels respectively and are linked by side panel 232 which is to pass continuously round one minor side edge of the charge of smoking articles and any inner frame. In the made-up pack panels 233 and 234 overlap and are sealed to each other on the opposite minor side edge.

End flaps 235 to 239 are respectively joined to panels 230 to 234 with potential fold lines being indicated in dotted lines. In particular, diagonal fold lines 240 interrupt the more major of the end flaps, namely flaps 235 and 236.

At the other edge of the main panels 230 to 234 are end flaps 241 to 245 respectively corresponding generally to flaps 235 to 239, and with fold lines 246 corresponding generally to fold lines 240.

However, as in the second embodiment, the major end flaps 241 and 242 are interrupted by cut lines which are to define an access flap into a sealed enclosure formed by this blank around a charge of smoking articles. Cuts 247 run parallel across flap 241 from closely adjacent its free edge into the main panel 230 to pips 248 from one to the other of which runs a U-shaped cut 249 in the main panel.

On end flap 242 are J-shaped cuts 250 extending from near the free edge of the flap to its potential fold line with panel 231, and leading to bridges 251 adjacent to which short cuts 252 lead to the free edge of the flap.

Figure 21:
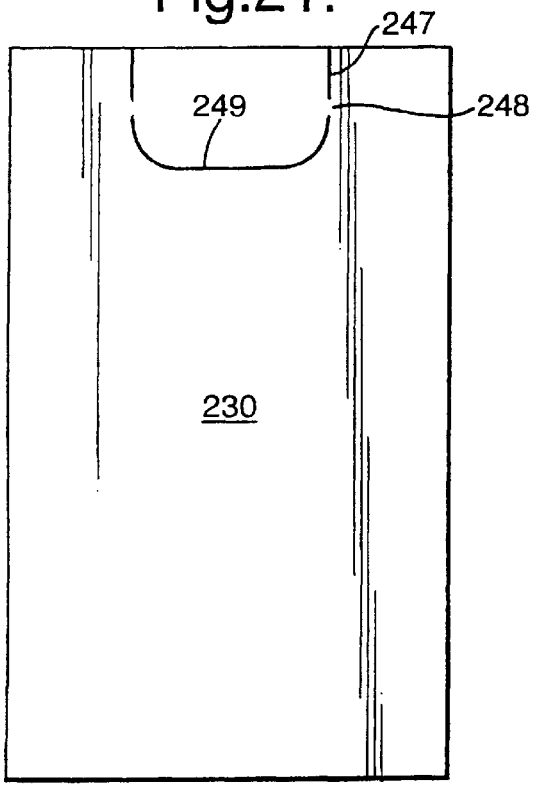
FIG. 21 shows a front view of the third embodiment when made up into a container.
Figure 22:
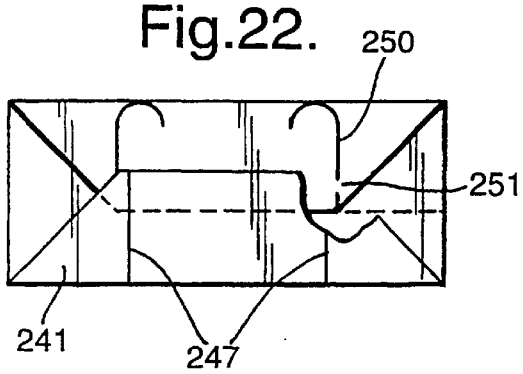
FIG. 22 shows a top plan view of the third embodiment when made up into a container, with a small portion cut away.

FIG. 21 shows a front view of the blank of FIG. 10 made up to a carton, and FIG. 22 a top view where again it is to be noted that cuts 247 and 251 do not coincide, although in contrast to the fourth embodiment cuts 250 are further apart in their flap than cuts 247 are. Again, the drawing has a small relief in flap 241 so that the bridge 251 in cut 250 can be seen.

Figure 23:
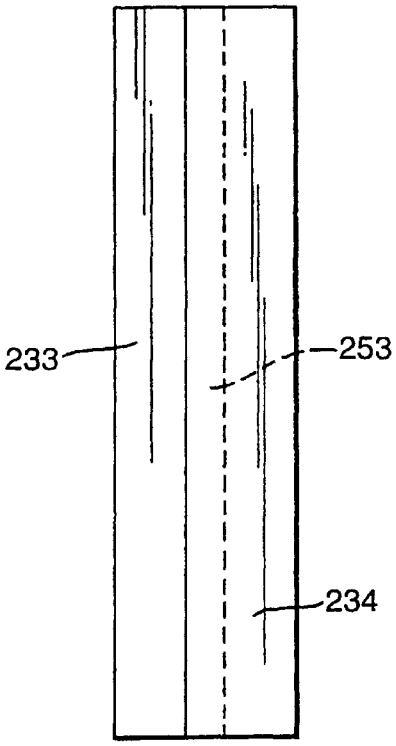
FIG. 23 shows one side view of the third embodiment when made up into a container.
Figure 24:
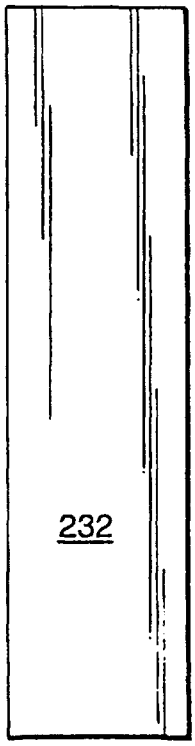
FIG. 24 shows a second side view of the third embodiment when made up into a container.

FIG. 23 shows the side seam 253 formed between panels 233 and 234 and FIG. 24 shows panel 232 on the other minor side of the charge. The clean effect on the sides can be noted, due to the formation of folds only on the top and bottom minor ends of the charge.

Figure 25:
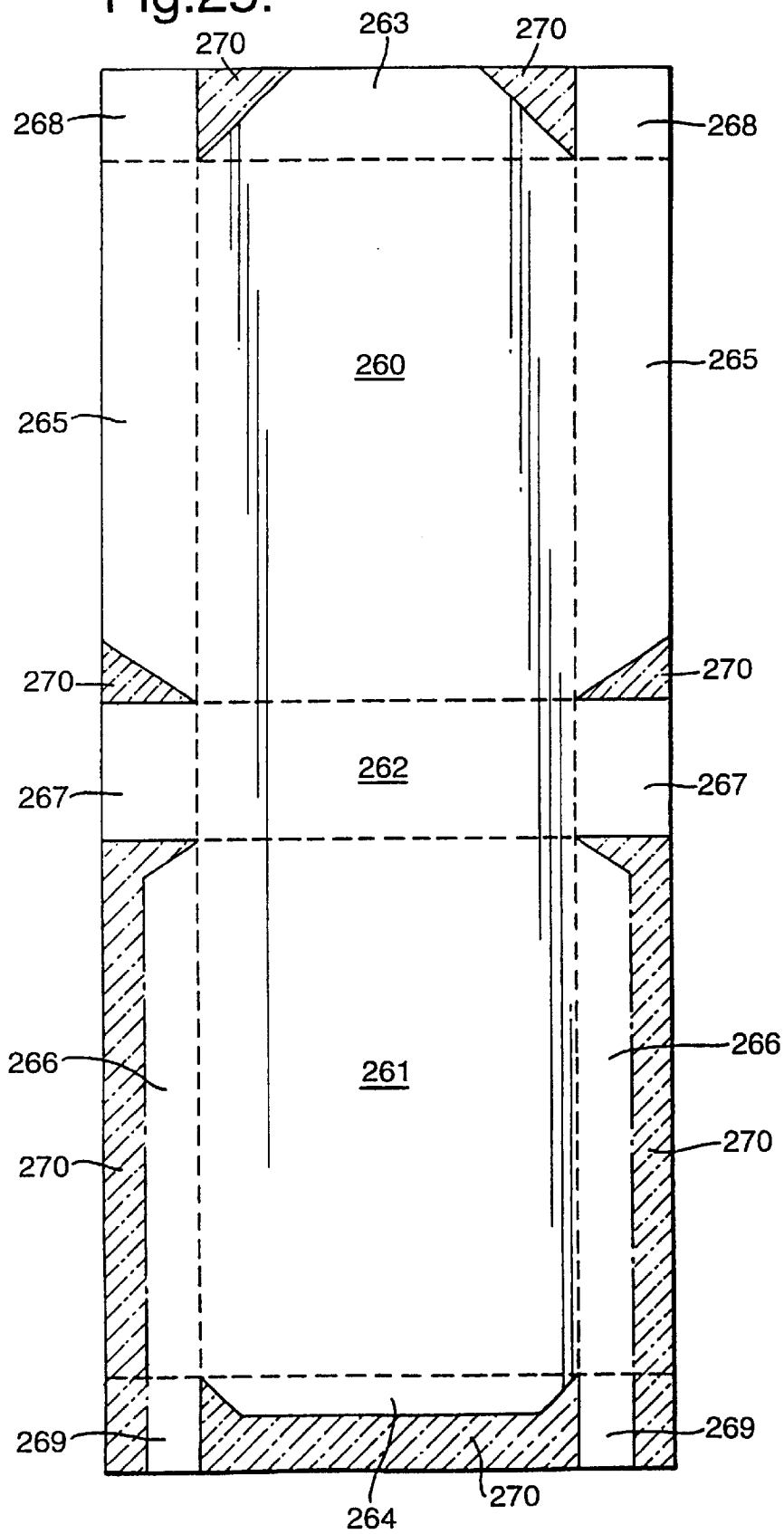
FIG. 25 shows heat-sealable areas on an inner face of a barrier blank.
Figure 26:
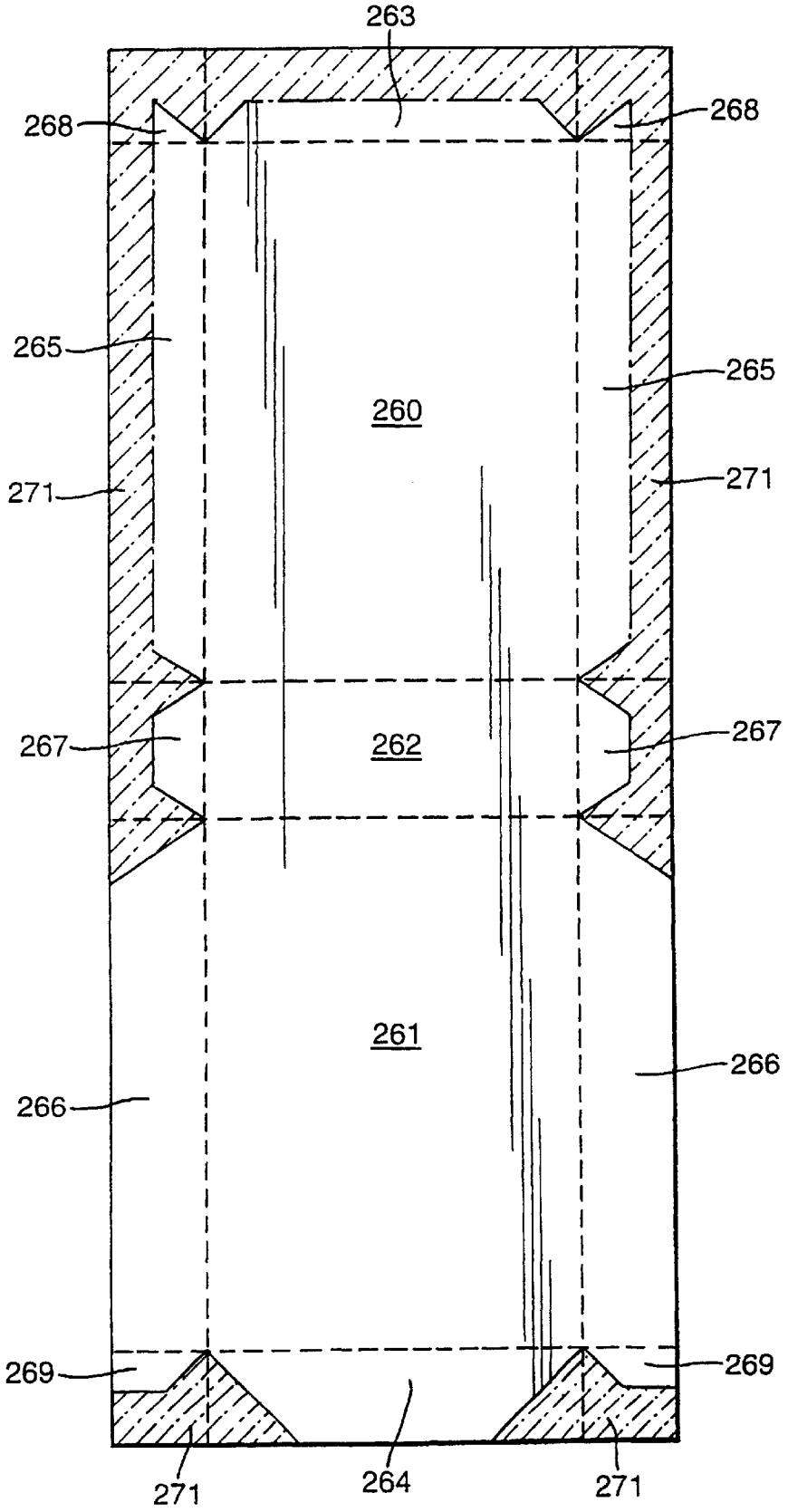
FIG. 26 shows heat-sealable areas on an outer face of a barrier blank.

Further embodiments of barrier layer blank are seen in FIGS. 25 and 26. The outline of these is schematic only—they may, for example, be any of the specific forms of blank described above where the barrier is continuous over one minor end of the charge and inner frame, and may have access-aperture defining lines or cuts.

In FIGS. 25 and 26 major panels 260,261 are joined by base panel 262 and lead to top flaps 263,264. Side and corner flaps 265 to 269 are along each side of the panels and flaps 260 to 264.

Cross-hatching shows areas 270 on the face (FIG. 25) destined to be inner and 271 (FIG. 26) on the face destined to be outer in the made-up pack are areas of heat-sealable lacquer or glue; alternatively heat-sealable areas of a plastics composition of the barrier material itself complement each other to form a continuous seal around all seams and folds of the sealed barrier enclosure.

Figure 27:
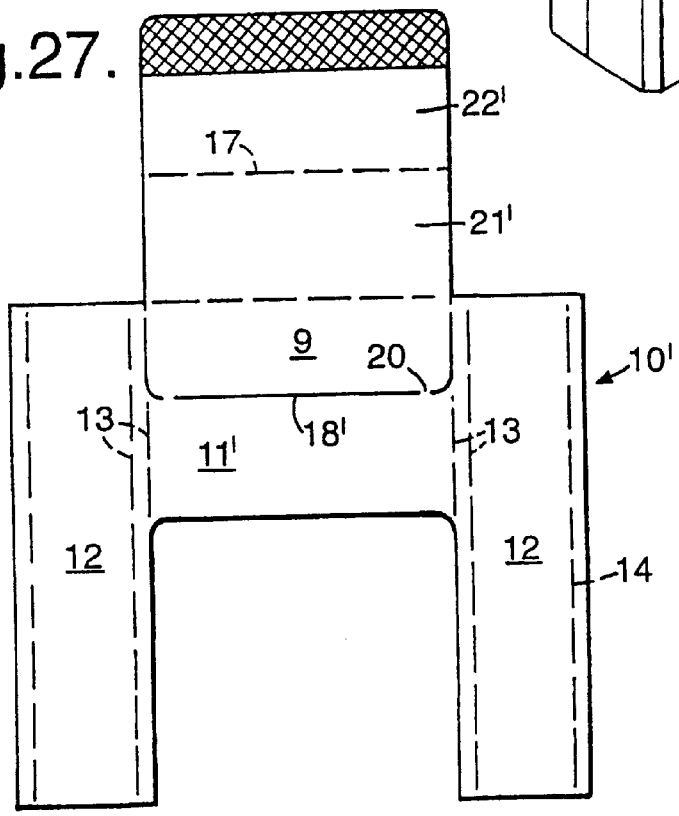
FIG. 27 shows a sixth embodiment of inner frame.

A sixth embodiment of the inner frame blank 10' is seen in FIG. 27. It has similarities to that of FIG. 3 and for that reason like reference numbers will be used, primed (') where there are differences.

Top panel 21' is extended in comparison with panel 21, to have a width similar to the front-to-back depth of the charge of smoking articles 15 to be packaged, and end panel 22' is to lie behind the charge 15. So that blanks may be cut without waste from a web of card, front panels 11' is correspondingly shortened.

Figure 28:
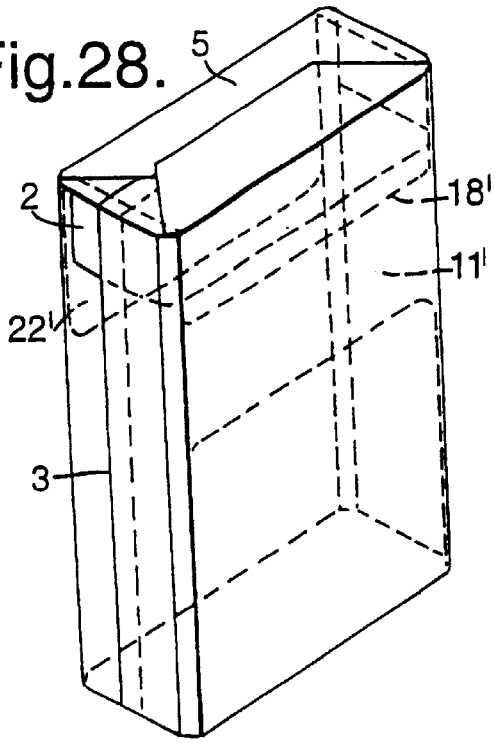
FIG. 28 shows a pack made up using the sixth embodiment.
Figure 29:
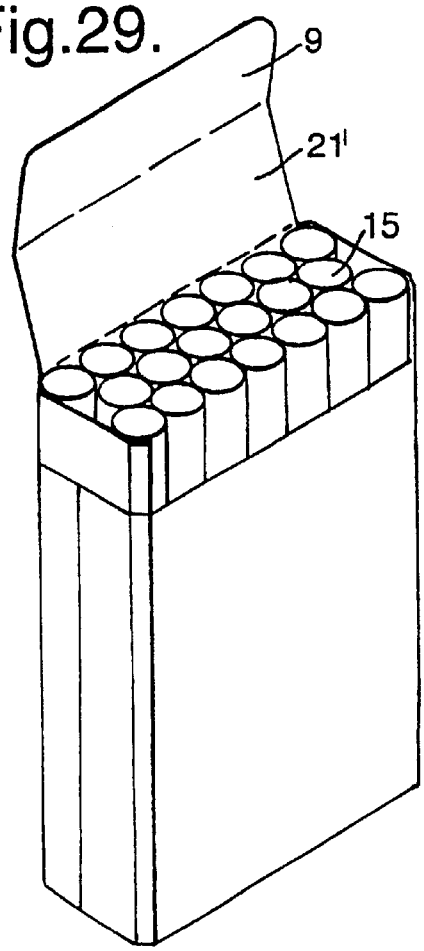
FIG. 29 shows the pack of FIG. 28, opened.

The pack is made up as before, as seen in FIG. 28. The end panel 22' is heat-sealed to the barrier layer only at its portion which lies below tear strip 2—see the corresponding hatched portion of end panel 22' in FIG. 27. When the tear strip 2, extending around the whole periphery of the pack, is pulled the whole of the top of the barrier material wrapping may be removed; the user then presses the front flap 9 inwardly to break the interruption 20, and can then lift that flap and top panel 21' as a lid hinged on the end panel 22', as seen in FIG. 29. Since the line of cut 18' is below the lower edge of the tear strip 2, an edge portion of the front flap 9 may be tucked into the remaining barrier material at the front of the pack, to reclose the pack.

What is claimed is:

1. A pack of smoking articles comprising:

a frame with a major panel, two side flaps, and at least a partial end flap placed adjacent a face, sides, and at least part of at least one end, respectively, of a charge of smoking articles, wherein said at least partial end flap consists of top flaps extending only partially over the top of the charge; and a flexible barrier sheet wrapping the charge and frame, and forming a sealed enclosure around them by virtue of sealed seams, characterized in that all of the sealed seams overlie at least partly a part of the frame.

2. The pack according to claim 1 wherein said major panel is the only major panel.

3. The pack according to claim 2 wherein free edges of said side flaps remote from said major panel form edges of said frame.

4. The pack according to claim 1 wherein the barrier material has a resealable access aperture.

5. The pack according to claim 1 wherein the frame surrounds the two minor sides, at least one end, and only one major face of a cuboid formed by said charge of smoking articles.

6. The pack according to claim 5 wherein said two side flaps of said frame are attached by one edge to said major panel, with the opposite edge of each said side flap being free.

7. The pack according to claim 1 wherein said top flaps are at least partially removable from said frame.

8. The pack according to claim 1 wherein said pack further comprises a soft outer wrap.

9. The pack according to claim 1 wherein said barrier sheet is comprised of a metal foil/plastics laminate or a metallized plastics film.

10. The pack according to claim 1 wherein said flexible barrier sheet is continuous over one minor end of said charge of smoking articles.

11. The pack according to claim 4 wherein said flexible barrier sheet is continuous in the location of said resealable access aperture.

12. A pack of smoking articles comprising:

a frame with a major panel, two side flaps, and at least a partial end flap placed adjacent a face, sides, and at least part of at least one end, respectively, of a charge of smoking articles, wherein said at least partial end flap is a base flap below the bottom of the charge, wherein said base flap and said side flaps are hingedly linked to respective edges of said major panel and further including top flaps extending only partially over the top of the charge hingedly linked to said side flaps; and a flexible barrier sheet wrapping the charge and frame, and forming a sealed enclosure around them by virtue of sealed seams characterized in that all of the sealed seams overlie at least partly a part of the frame.

13. The pack according to claim 12 wherein said major panel is the only major panel.

14. The pack according to claim 12 wherein the barrier material has a resealable access aperture.

15. The pack according to claim 12 wherein the frame surrounds the two minor sides, at least one end, and only one major face of a cuboid formed by said charge of smoking articles.

16. The pack according to claim 12 wherein said barrier sheet is comprised of a metal foil/plastics laminate or a metallized plastics film.

17. The pack according to claim 12 wherein said flexible barrier sheet is continuous over one minor end of said charge of smoking articles.

18. The pack according to claim 14 wherein said flexible barrier sheet is continuous in the location of said resealable access aperture.

19. A pack of smoking articles comprising:

a frame with a major panel, two side flaps, and at least a partial end flap placed adjacent a face, sides, and at least part of at least one end, respectively, of a charge of smoking articles; and a flexible barrier sheet wrapping the charge and frame, and forming a sealed enclosure around them by virtue of sealed seams characterized in that all of the sealed seams overlie at least partly a part of the frame, wherein the barrier material has a resealable access aperture and further wherein said resealable access aperture is covered by a cover layer having edge portions overlapping the barrier material surrounding the access aperture, with a permanently tacky adhesive on said edge portions.

20. The pack according to claim 19 wherein the permanently tacky adhesive includes microcapsules of a flavourant.

21. The pack according to claim 19 wherein said barrier sheet is comprised of a metal foil/plastics laminate or a metallized plastics film.

22. The pack according to claim 19 wherein said flexible barrier sheet is continuous over one minor end of said charge of smoking articles.

23. The pack according to claim 19 wherein said flexible barrier sheet is continuous in the location of said resealable access aperture.

24. A pack of smoking articles comprising:

a frame with a major panel, two side flaps, and at least a partial end flap placed adjacent a face, sides, and at least part of at least one end, respectively, of a charge of smoking articles, wherein said major panel is the only major panel, and further wherein free edges of said side flaps remote from said major panel form edges of said frame; and a flexible barrier sheet wrapping the charge and frame, and forming a sealed enclosure around them by virtue of sealed seams characterized in that all of the sealed seams overlie at least partly a part of the frame, wherein the barrier material has a resealable access aperture and further wherein said resealable access aperture is covered by a cover layer having edge portions overlapping the barrier material surrounding the access aperture, with a permanently tacky adhesive on said edge portions.

25. A pack of smoking articles comprising:

a frame with a major panel, two side flaps, and at least a partial end flap placed adjacent a face, sides, and at least part of at least one end, respectively, of a charge of smoking articles, wherein the frame surrounds the two minor sides, at least one end, and only one major face of a cuboid formed by said charge of smoking articles, and further wherein said frame overlies both ends of the charge, with a base flap to surround a base of the charge and top flaps only partially surrounding a top of the charge; and a flexible barrier sheet wrapping the charge and frame, and forming a sealed enclosure around them by virtue of sealed seams characterized in that all of the sealed seams overlie at least partly a part of the frame.

26. The pack according to claim 25 wherein each of said side and said end flaps is attached through only one edge.

27. The pack according to claim 25 wherein the charge is a 7-6-7 charge of cigarettes.

28. The pack according to claim 25 wherein said frame includes a flavourant thereon.

29. The pack according to claim 25 wherein said barrier sheet has a resealable access aperture, said resealable access aperture being covered by a cover layer having edge portions overlying the barrier sheet surrounding the access aperture.

* * * * *